US005177984A

United States Patent [19]

Arata

[11] Patent Number: 5,177,984

[45] Date of Patent: Jan. 12, 1993

[54] CONCANE SURFACE HOLLOWED-BOTTOM BEZEL FOR FLUSH-PRECIOUS STONES

[76] Inventor: Aldo Arata, Viale Manzoni, 33/N, 15048 Valenza (Alessandria), Italy

[21] Appl. No.: 775,699

[22] Filed: Oct. 10, 1991

[30] Foreign Application Priority Data

Jan. 16, 1991 [IT] Italy ..... MI91A-00095

[51] Int. Cl.[5] ..... A44C 17/02

[52] U.S. Cl. ..... 63/26; D11/91

[58] Field of Search ..... D11/91, 26, 35; 63/26, 63/28, 29, 32, 31, 15

[56] References Cited

U.S. PATENT DOCUMENTS

| | | | |
|---|---|---|---|
| D. 159,410 | 7/1950 | Frackman | D11/91 |
| 739,759 | 9/1903 | Stafford | 63/15 |
| 829,388 | 8/1906 | Doran | D11/91 |
| 1,035,909 | 8/1912 | Robbins | 63/28 |
| 1,941,782 | 1/1934 | Bayer | 63/26 |
| 2,141,363 | 12/1938 | Rigollet | 63/26 |
| 2,536,206 | 1/1951 | Newhouse | 63/26 |
| 3,910,066 | 10/1975 | Strack | 63/26 |
| 5,003,678 | 4/1991 | Oganesyan | 63/26 |

FOREIGN PATENT DOCUMENTS

| | | | |
|---|---|---|---|
| 532008 | 2/1950 | Canada | 63/26 |
| 557624 | 8/1923 | France | 63/28 |

*Primary Examiner*—Renee S. Luebke
*Assistant Examiner*—Flemming Saether
*Attorney, Agent, or Firm*—Bucknam and Archer

[57] ABSTRACT

The present invention relates to a bezel for restraining precious stones and the like, on jewels in general, comprising an ellipsoidal or drop-shape recess, formed on a surface of a jewel and having, on its intermediate portion, a recessed seat for housing the pavilion of a precious stone, the ellipsoidal recess being provided, near the recessed seat, with several opposite projections which can be engaged with perimetrical portions of the precious stone.

2 Claims, 2 Drawing Sheets

CONCANE SURFACE HOLLOWED-BOTTOM BEZEL FOR FLUSH-PRECIOUS STONES

BACKGROUND OF THE INVENTION

The present invention relates to a precious stone bezel, for restraining precious stones and the like on jewels in general.

As is known, for making jewels provided with precious stones and the like, these precious stones can be restrained by different methods, which, generally, comprise a coupling of the precious stone by means of clamp elements or by the so-called jewel bezel.

The clamped coupling of a precious stone is usually performed by using small lug elements extending from the jewel body and the free end portions of which are bent, at the perimetrical edge of the precious stones, so as to restrain the stone at several restraining points.

Even if this type of coupling has the advantages of enhancing the light refraction of a precious stone, it, however, has the main drawback that it can not suitably protect the precious stone, since the clamping lugs are susceptible to get entangled in threads and the like, with a consequent spreading of the lugs and a possible loss of the precious stone.

Another drawback is that the stone, being completely exposed, is not protected against impacts susceptible to damage it.

The use of a bezel is of course more efficient from a mere mechanical standpoint, since the stone is restrained by a small edge all along the perimeter thereof and, accordingly, a safe coupling is obtained.

However, even in this type of coupling, one has the drawback that the bezel, by superimposing for a portion on the periphery of the precious stone, practically reduces the light refracting properties of the stones and, moreover reduces its visible size.

Moreover, even in this case, the stone is not suitably protected against possible impacts, since it projects from the jewel body.

SUMMARY OF THE INVENTION

Accordingly, the aim of the present invention is to overcome the above mentioned drawbacks, by providing a new bezel construction for restraining precious stones and the like on jewels in general, which affords the possibility of safely restraining the stone on the jewel, while improving its light refraction characteristic.

Within the scope of the above mentioned aim, a main object of the present invention is to provide a bezel adapted to properly protect the precious stone against possible impacts on the light.

Yet another object of the present invention is to provide such a bezel for precious stones which is very reliable and safe in operation.

According to one aspect of the present invention, the above mentioned aim and objects, as well as yet other objects, which will become more apparent hereinafter, are achieved by a bezel for restraining precious stones on jewels in general, characterized in that said bezel comprises an ellipsoidal recess formed on a surface of a jewel body and including, at its intermediate position, a recessed seat for housing the pavilion of a precious stone, said ellipsoidal recess being provided, near said recessed seat, with several opposite projections, which can be engaged with perimetrical portions of said stone.

BRIEF DESCRIPTION OF THE DRAWINGS

Further characteristics and advantages of the invention will become more apparent from the following detailed disclosure of an embodiment of a bezel for restraining precious stones and the like on jewels in general, according to the invention, which is illustrated, by way of an indicative but not limitative example, in the accompanying drawings, in which.

DESCRIPTION OF THE PREFERRED EMBODIMENTS

Figure 5:
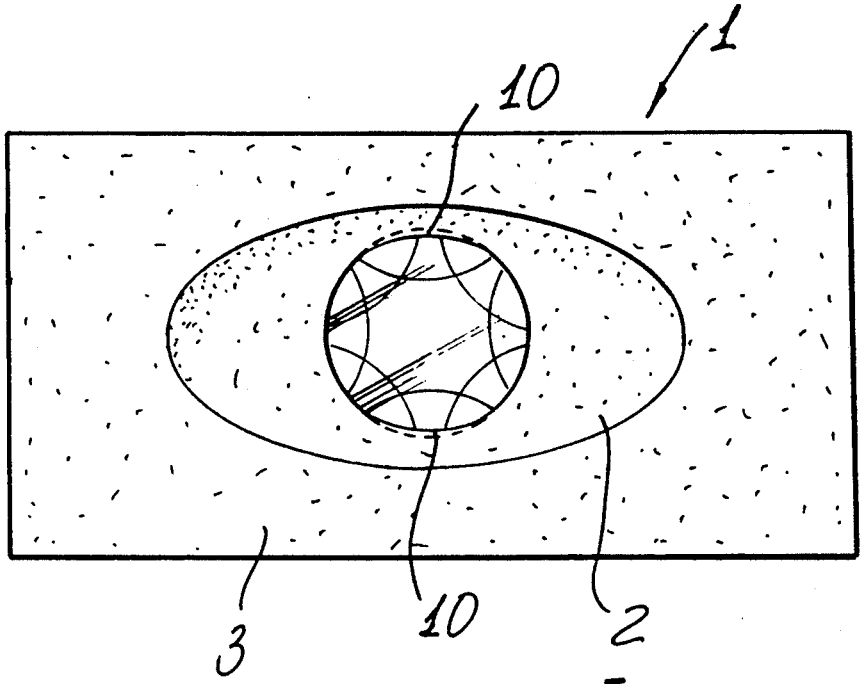
FIG. 5 is a top plan view of the precious stone restrained by the bezel.
Figure 1:
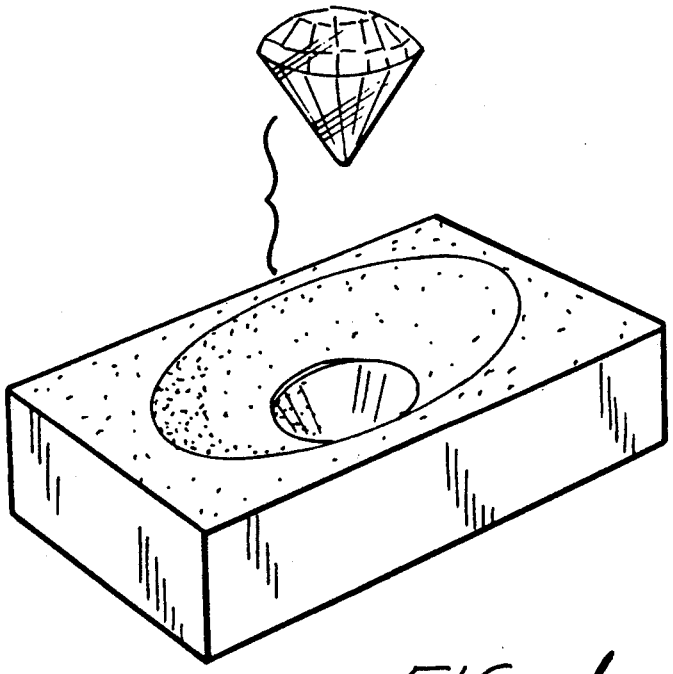
FIG. 1 is a perspective exploded view of the bezel construction according to the present invention and a generic precious stone.
Figure 2:
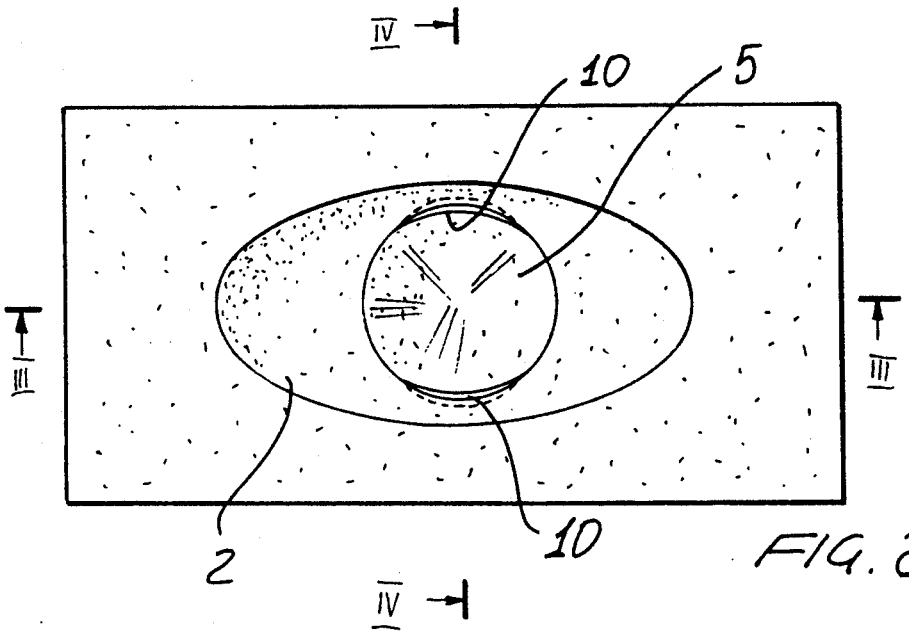
FIG. 2 is top plan view of the bezel.
Figure 3:
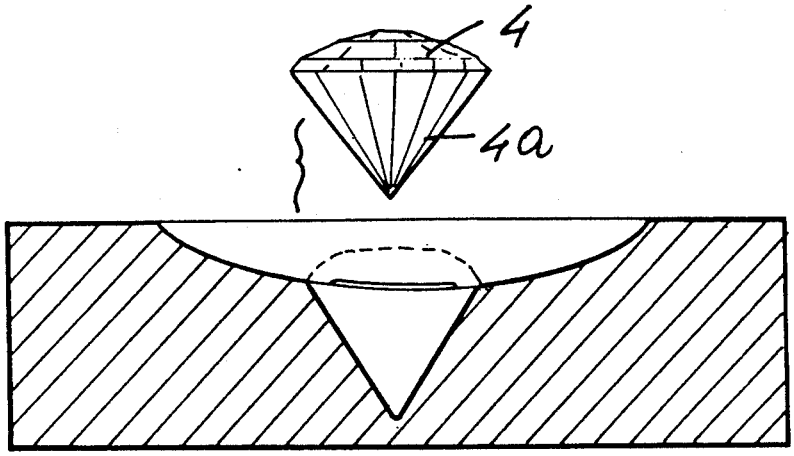
FIG. 3 shows, by a further exploded view, a section of the bezel according to the invention, substantially taken along the section line III—III of FIG. 2.
Figure 4:
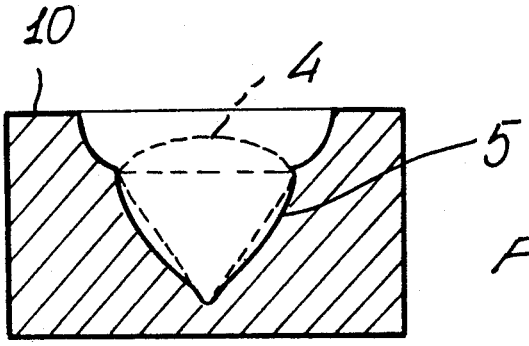
FIG. 4 shows a further cross-sectional view of the bezel, taken along the section line IV—IV of FIG. 2.

With reference to the figures of the accompanying drawings, the bezel construction for restraining precious stones and the like, on jewels in general, which is generally indicated at the reference number 1, comprises a recess or cavity 2 which is formed on the surface of the jewel 3 to which a generic precious stone 4 must be applied.

The recess has a concave surface and a substantially ellipsoidal or drop shape, or any other suitable elongated shape.

At the intermediate bottom portion of the recess 2 there is formed a small recess or seat 5, having substantially a conic shape, which follows the shape of the pavilion 4*a* of the stone 4.

At two opposite points of the recess 2, which points are preferably symmetrically arranged with respect to the main axis of the recess 2, there are provided projections 10, at the top edge of the seat 5.

The projections 10 are provided for engaging with perimetrical portions of the stone 4 so as to operate as tension restraining elements for the stone.

More specifically, after having introduced the stone into the seat 5, the material forming the projections 10 is riveted or rolled in, so as to provide a restraining edge which is superimposed, for a small portion, on the contour of the stone.

After having restrained the stone, the recess 2 is mirror-like polished in order to provide a reflection region adapted to provide a visual feeling of a greater size stone, since the actual stone, which appears to be more brilliant, is fully visible.

Thus, the stone is so restrained that its view exposed surface is fully held in the recess and, accordingly, the stone does not present any projection portions susceptible to be damaged upon impacts.

From the above disclosure it should be apparent that the invention fully achieves its aim and objects.

While the invention has been disclosed and illustrated with reference to a preferred embodiment thereof, it should be apparent that the disclosed embodiment is susceptible to several modifications and variations all of which will come within the spirit and scope of the appended claims.

I claim:

1. A bezel for setting precious stones comprising a bezel body, an ellipsoidal concave polished recess formed in said body, said ellipsoidal concave recess having a major axis and a minor axis and including, at an intermediate bottom portion thereof, a conic seat mating with a pavilion portion of a precious stone for flush-housing said pavilion therein, said ellipsoidal recess being provided, at edge top portions of said conic seat, with a pair of opposite projections adapted to engage perimetrical top portions of said stone to flush-set said stone in said conic seat.

2. A bezel according to claim 1, wherein said projections are symmetrically arranged with respect to said major axis of said ellipsoidal recess.

* * * * *